US006926376B2

(12) United States Patent
Arent et al.

(10) Patent No.: US 6,926,376 B2
(45) Date of Patent: Aug. 9, 2005

(54) MODULAR WORKBENCH SYSTEM

(75) Inventors: Thomas Wesley Arent, St. Joseph, MI (US); Todd Christopher Starr, St. Joseph, MI (US); Allan Ray Steinkuhl, Evansville, IN (US); Mark Allen Stout, Evansville, IN (US); John Richard Wisnoski, Haubstadt, IN (US); Kenneth L. Patricio, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 122 days.

(21) Appl. No.: 10/334,078

(22) Filed: Dec. 30, 2002

(65) Prior Publication Data

US 2004/0124751 A1 Jul. 1, 2004

(51) Int. Cl.[7] ..... A47B 97/00

(52) U.S. Cl. ..... 312/249.9; 312/249.1; 312/194

(58) Field of Search ..... 312/249.1, 249.8, 312/194; 52/36.1

(56) References Cited

U.S. PATENT DOCUMENTS

| | | | | |
|---|---|---|---|---|
| 376,070 A | | 1/1888 | Cobb et al. | |
| 1,610,626 A | | 12/1926 | Smith | |
| D95,158 S | | 4/1935 | Surerus | |
| 2,455,182 A | | 11/1948 | Vallee | 62/116 |
| 2,490,494 A | | 12/1949 | Widman | 62/89 |
| 2,981,577 A | | 4/1961 | Trautman | 311/35 |
| 3,243,246 A | | 3/1966 | Eversman et al. | 312/194 |
| 4,002,383 A | | 1/1977 | Holloway, Jr. | 312/209 |
| 4,026,616 A | * | 5/1977 | Kuehl | 312/249.9 |
| 4,050,752 A | | 9/1977 | Dykstra | 312/243 |
| 4,055,362 A | | 10/1977 | Becker, III | 293/62 |
| 4,272,136 A | | 6/1981 | Sengua | 312/296 |

(Continued)

FOREIGN PATENT DOCUMENTS

| | | | |
|---|---|---|---|
| EP | 0141787 | 5/1985 | A47B/77/02 |
| GB | 2142838 | 5/1984 | A47B/83/00 |
| JP | 404319308 A * | 11/1992 | |

*Primary Examiner*—Peter M. Cuomo
*Assistant Examiner*—Erika Garrett
(74) *Attorney, Agent, or Firm*—Stephen Krefman; Robert O. Rice; John F. Colligan

(57) ABSTRACT

A heavy-duty workbench with strong metal legs and a thick hardwood top. The workbench can provide docking space for three modules that can function as an additional work surface when pulled out from under the workbench or when used alone. The modules can be provided with an optional hardwood top. The modules can have large heavy-duty casters to facilitate easy movement for use and cleaning. The workbench and modules are designed for use in non-climate controlled spaces such as a garage where temperature and humidity extremes are common. Electrical outlets can be provided in an optional backsplash mounted at the rear edge of the workbench.

43 Claims, 9 Drawing Sheets

U.S. PATENT DOCUMENTS

| | | | | | |
|---|---|---|---|---|---|
| 4,337,988 | A | | 7/1982 | Schenck | 312/280 |
| 4,365,854 | A | | 12/1982 | Waller | 312/250 |
| 4,408,642 | A | | 10/1983 | Jeruzal et al. | 144/286 |
| 4,457,140 | A | * | 7/1984 | Rastelli | 62/261 |
| 4,893,885 | A | * | 1/1990 | Borello | 312/249.9 |
| 5,020,867 | A | * | 6/1991 | McManus | 312/314 |
| 5,205,629 | A | | 4/1993 | Simons | 312/249.9 |
| 5,224,531 | A | | 7/1993 | Blohm | 144/285 |
| 5,507,570 | A | * | 4/1996 | Williams et al. | 312/249.9 |
| 5,666,887 | A | | 9/1997 | Grabowski et al. | 108/91 |
| 5,743,603 | A | * | 4/1998 | Kelley et al. | 312/195 |
| 5,984,439 | A | | 11/1999 | Orr et al. | 312/140.2 |
| 6,047,750 | A | | 4/2000 | Jensen | 144/286 |
| 6,048,044 | A | * | 4/2000 | Biggel et al. | 312/258 |
| 6,053,588 | A | * | 4/2000 | Biggel et al. | 312/249.8 |
| D437,706 | S | | 2/2001 | Alcala et al. | D6/397 |
| 6,202,567 | B1 | | 3/2001 | Funk et al. | 108/50.02 |
| 6,282,914 | B1 | | 9/2001 | Steinhoff et al. | 62/302 |
| 6,402,273 | B1 | * | 6/2002 | Czesnik et al. | 312/235.1 |
| D471,377 | S | | 3/2003 | Gledhill et al. | D6/432 |
| D474,563 | S | | 5/2003 | Bresciani | D29/109 |
| 6,634,631 | B2 | | 10/2003 | Hebert | 269/45 |
| 6,692,092 | B1 | * | 2/2004 | Evans | 312/311 |

* cited by examiner

MODULAR WORKBENCH SYSTEM

DESCRIPTION OF THE INVENTION

A modular workbench and storage system according to the invention can provide a heavy duty workbench and storage space for one or more modules that can dock underneath the workbench. The workbench and storage system according to the invention can be used in conjunction with the slotwall panel storage system disclosed in co-pending patent application US20020232 filed concurrently with this application.

Figure 1:
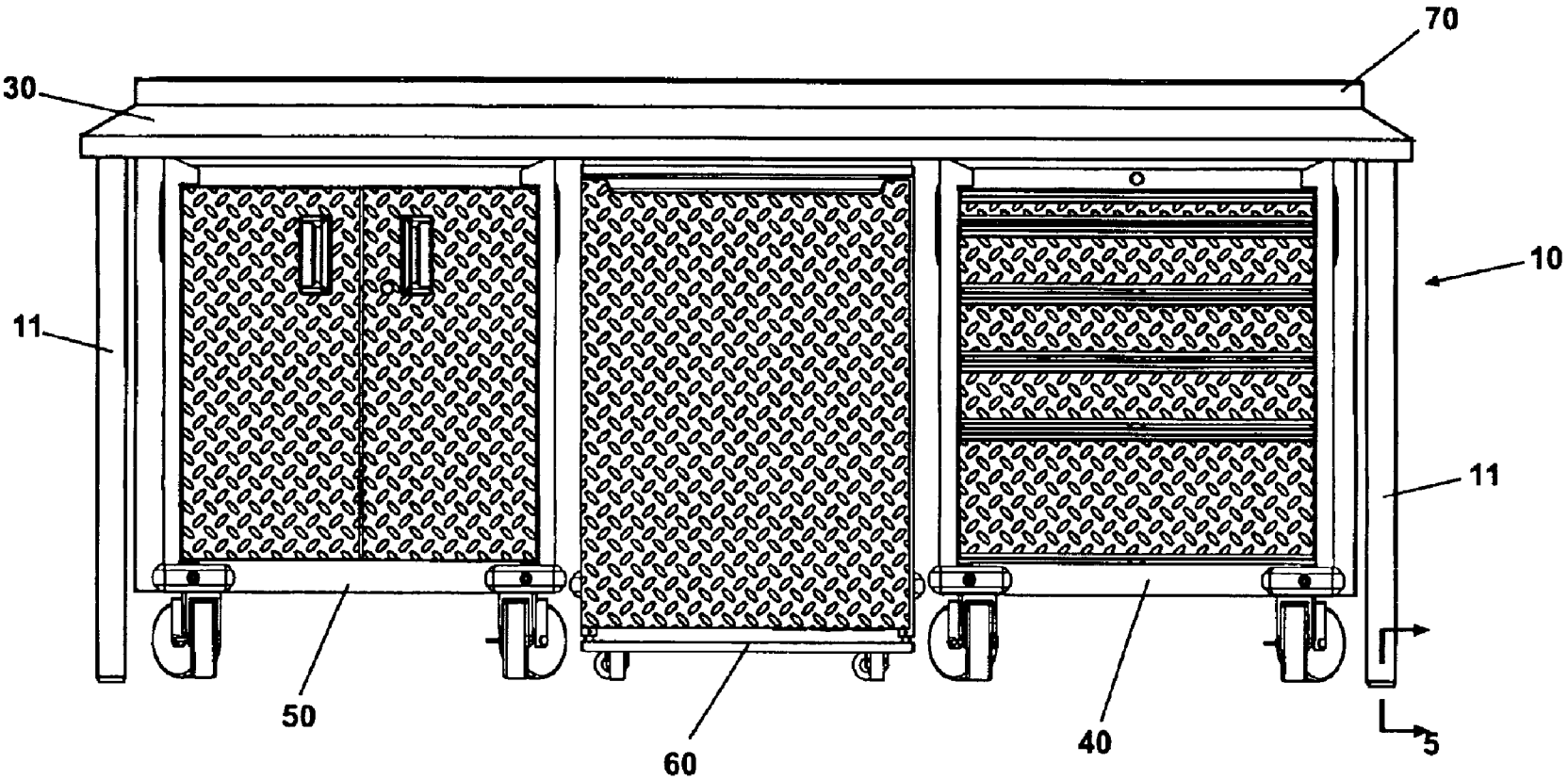
FIG. 1 is a front perspective view of the modular workbench system.

Referring to FIG. 1, a modular workbench system according to the invention is shown. Workbench 10 can include a leg assembly 11 at each end of the workbench and a top 30. Top 30 can be laminated hard wood or other sturdy, durable material as is well known in the art. In the embodiment shown in FIG. 1, top 30 can be 1¾ inches thick laminated hard wood maple strips that run lengthwise in top 30 to provide a strong heavy-duty worksurface. The workbench 10 shown in FIG. 1 can be 8 feet long, 38 inches high and 25 inches deep to provide ample worksurface and storage area for up to three modules. Those skilled in the art will understand that the length of the workbench can be longer or shorter as desired to provide space for docking two modules or more than the three modules as shown in the embodiment of FIG. 1. For example, the workbench could be made 6 feet long and provide storage space for two modules. Likewise the height and width of the workbench can be adjusted as desired. The modules can include a drawer module 40, a storage cabinet module 50 and a refrigerator module 60. Refrigerator module 60 can be a low ambient temperature refrigerator as disclosed in co-pending patent application US20020323 filed concurrently with this patent application and incorporated by reference. Those skilled in the art will understand that other modules can be provided as desired. In addition, less than three modules can be provided for use with workbench 10 and more than one of a particular module can be used with workbench 10 as desired by the user.

Figure 2:
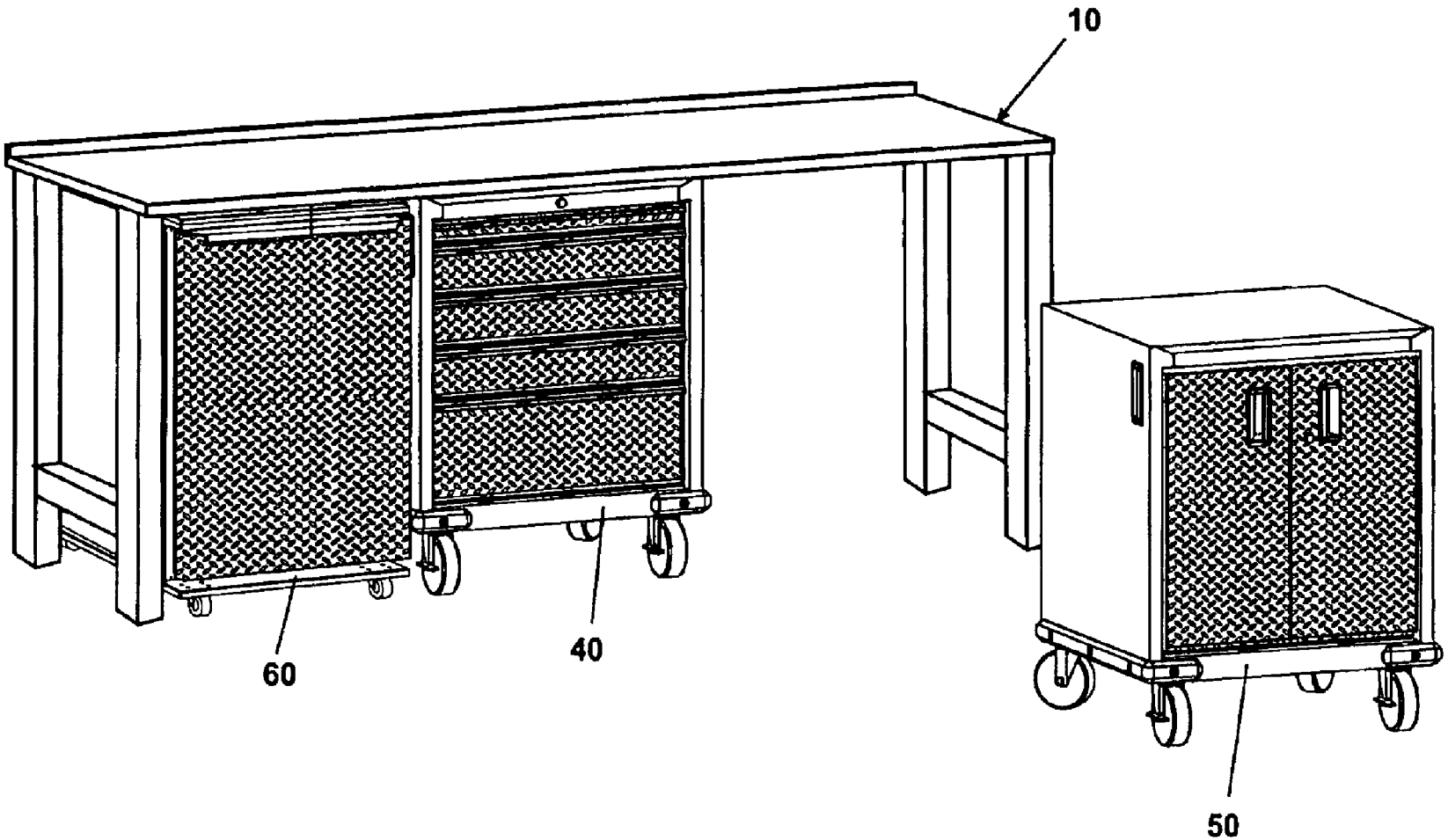
FIG. 2 is a front perspective view of the modular workbench system with one module moved out from under the workbench and positioned as an auxiliary worksurface.

The modules can be provided with heavy duty casters, as described in detail below, to facilitate movement for docking underneath the workbench 10, rearrangement of the modules underneath the workbench, or to facilitate positioning away from the workbench for cleaning under the workbench or for use as a mobile worksurface. Referring FIG. 2, one of the modules, storage cabinet module 50, is shown withdrawn from under the workbench for use as a mobile worksurface. While storage cabinet module 50 is shown withdrawn those skilled in the art will recognize that any or all of the modules can be so withdrawn for use as a mobile worksurface or positioned elsewhere as a remote storage module.

Figure 3:
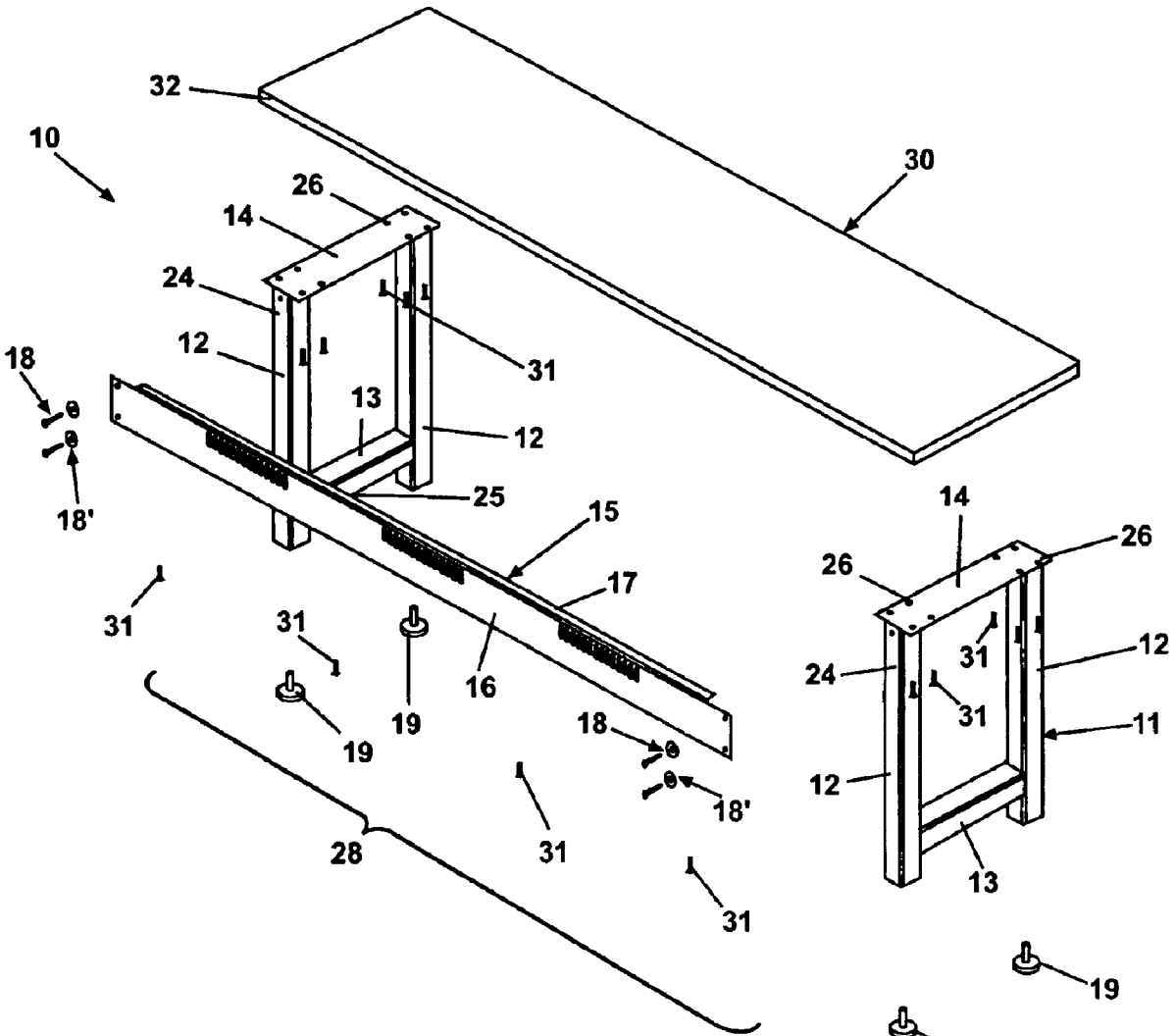
FIG. 3 is an exploded rear perspective view of the modular workbench.

Referring to FIG. 3, the workbench 10 is shown with top 30 removed and spaced from the leg assemblies 11 and stringer 15. Each leg assembly 11 can include two legs 12, a bottom spacer 13 and a top plate 14. Leg assembly 11 can be fabricated of metal such as steel, and welded together. Each of the legs 12 and bottom spacer 13 can be square tubes that can be approximately 3 inches square. Top plate 14 can be wider than legs 12 to provide a mounting flange on each side of leg assembly 12. Each top plate 14 can have a plurality of elongated mounting holes 26 provided in two rows on either side of legs 12. As shown in FIG. 3, there can be 8 elongated mounting holes 26 in top plate 14, four being adjacent each leg 12. As those skilled in the art will understand, less than 8 elongated mounting holes 26 can be provided in top plate 14, and plate 14 could be substantially the same width as legs 12 with elongated holes 26 positioned between legs 12. Mounting holes 26 can be eliminated altogether and stringer 15 can be used to attach workbench top 30 to the leg and stringer assembly 28 as described below. If mounting holes 26 are eliminated from plates 14, some alternate fastener can be used in the vicinity of the front leg 12 of each leg assembly 11 to prevent top 30 from lifting off the leg assemblies during use as will be understood by those skilled in the art.

Leg assemblies 11 can be connected with stringer 15 that can be a metal plate extending from one rear leg to the opposite rear leg. Stringer 15 can include a vertical plate 16 that can be attached to legs 12 to form a leg and stringer assembly 28 including a pair of leg assemblies 11 and a stringer 15. Stringer 15 can also include a mounting flange 17 that can be formed on the top edge of stringer 15. In the embodiment of FIG. 1 vertical plate 16 can be 6 inches wide and mounting flange 17 can be 1 inch wide. Stringer 15 can be attached to leg assemblies 11 with a plurality of mounting bolts 18 and washers 18' to the rear surface of rear legs 12 as is well known to those skilled in the art. While flat washers 18' are shown, those skilled in the art will understand that lock washers could be used instead of, or in addition to flat washers 18'. Mounting bolts 18 can be threadably attached to legs 12 by weld nuts 24 attached to rear legs 12. Stringer 15 can have a plurality of vents 27 formed in vertical plate 16 to prevent build up of heat under workbench 10 as discussed in more detail below. Vent 27 can comprise a plurality of vertical slots 29 adjacent the upper edge of vertical plate 16. In the embodiment shown in FIG. 1, there can be 3 vents spaced across stringer 15 each having a plurality of slots 29. In the embodiment shown in FIG. 1 and FIG. 3 there can be 25 slots 29 in each vent 27 and the slots 29 can be 2 inches long and ¼ inch wide with alternate slots 29 offset by ½ inch. While stringer 15 is shown in this embodiment as a separate component from leg assemblies 11 to facilitate shipping, it will be appreciated by those skilled in the art that the stringer 15 could be permanently attached to leg assemblies 11 as by welding. Stringer 15 can be fabricated of metal such as steel. Leg assemblies 11 and stringer 15 can be finished as desired such as by painting. Those skilled in the art will recognize that the dimensions of the stringer and vents can be adjusted as desired.

Figure 5:
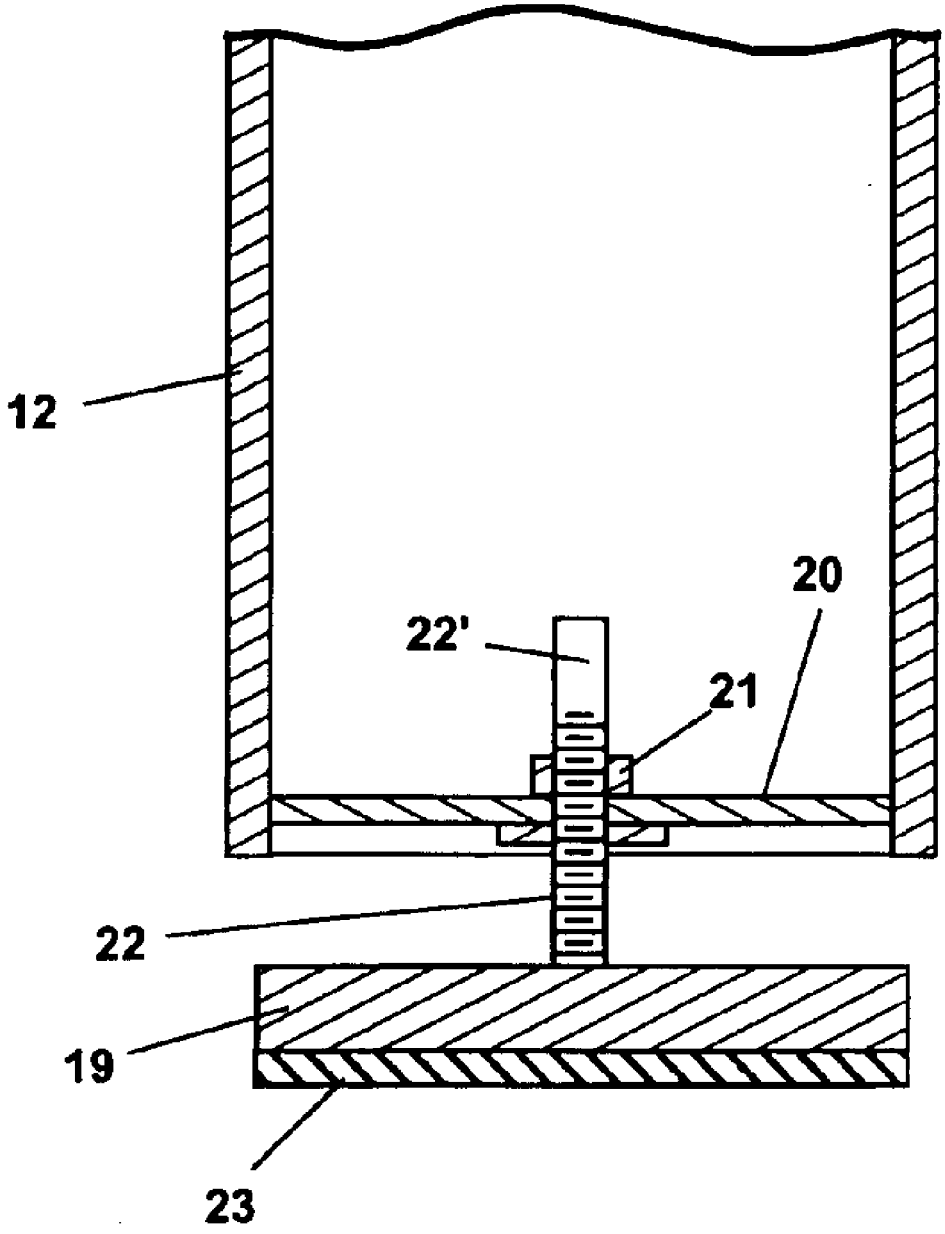
FIG. 5 is a partial sectional view of a workbench leg showing the leveling mechanism.

Referring to FIG. 3 and FIG. 5, each leg 12 can have a bottom wall 20 that can be welded into the bottom end of leg 12. Bottom wall 20 can have a threaded fastener such as a tee nut 21 welded in the center of bottom wall 20. A leveling foot 19 can be provided for each leg 12 that can include a threaded portion 22 fastened to foot 19 and adapted to be threaded into tee nut 21 in bottom wall 20. The top portion 22' of threaded portion 22 can be provided without threads to prevent threaded portion 22 from backing all the way out of tee nut 21 such as when workbench 10 is being moved across the floor. Providing the top portion 22' without threads can also facilitate assembly, in that one corner of the workbench can be lifted and a leveling foot 19 inserted into tee nut 21 without having to start the threads on threaded portion 22 upon insertion of threaded portion 22 into tee nut 21. Leveling foot 19 can have a pad 23 on the bottom surface to provide a non-slip surface on leveling foot 19. Pad 23 can be nylon or rubber or other material as will is well known to those skilled in the art. Those skilled in the art will understand that another form of leveling mechanism for some or all of the legs 12 could be provided as desired, or that a leveling mechanism could be omitted.

Elongated mounting holes 26 in top plate 14 and mounting holes 25 in mounting flange 17 can receive a plurality of fasteners 31 for attaching top 30 to the leg and stringer assembly 28. Fasteners 31 can be lag screws and pilot holes (not shown) can be pre-drilled in top 30 to facilitate locating and attaching top 30 to leg and stringer assembly 28. Mounting holes 26 are elongated in the plane of leg assembly 11 to allow for expansion and contraction of top 30 over the range of humidity conditions likely to be encountered in a non-climate controlled environment such as a basement, a garage or other outdoor work area. Thus, elongated mounting holes 26 are positioned to allow the width of the laminated hard wood maple top to expand and contract with changes in humidity. Mounting holes 25 in mounting flange 17 can be circular since laminated hard wood maple top 30 is unlikely to expand and contract along the direction of the laminated wood strips. In addition, use of round mounting holes 25 in mounting flange 17 can provide a sturdy workbench since the leg and stringer assembly can not shift under top 30 as the fasteners 31 can lock top 30 to the leg and stringer assembly 28. Those skilled in the art will understand that if top 30 is formed of strips of hard wood that run from front to back instead of side to side that mounting holes 26 could be round and mounting holes 25 elongated along the length of stringer 15 to allow for expansion and contraction in that direction.

Figure 4A:
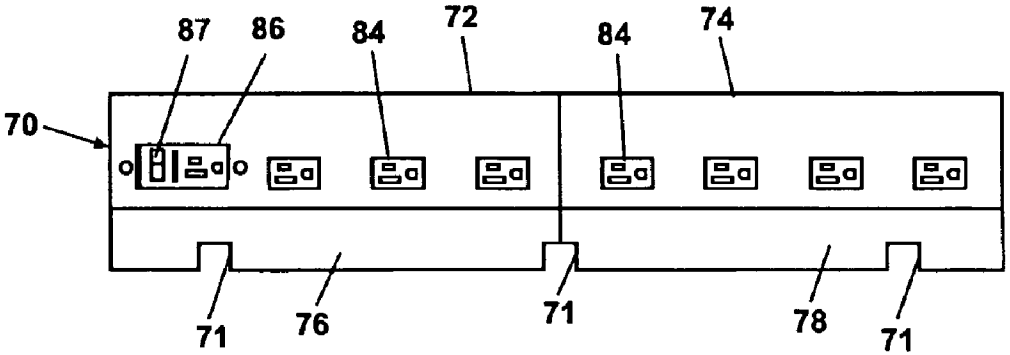
FIG. 4A is a schematic front view of the power strip.
Figure 4:
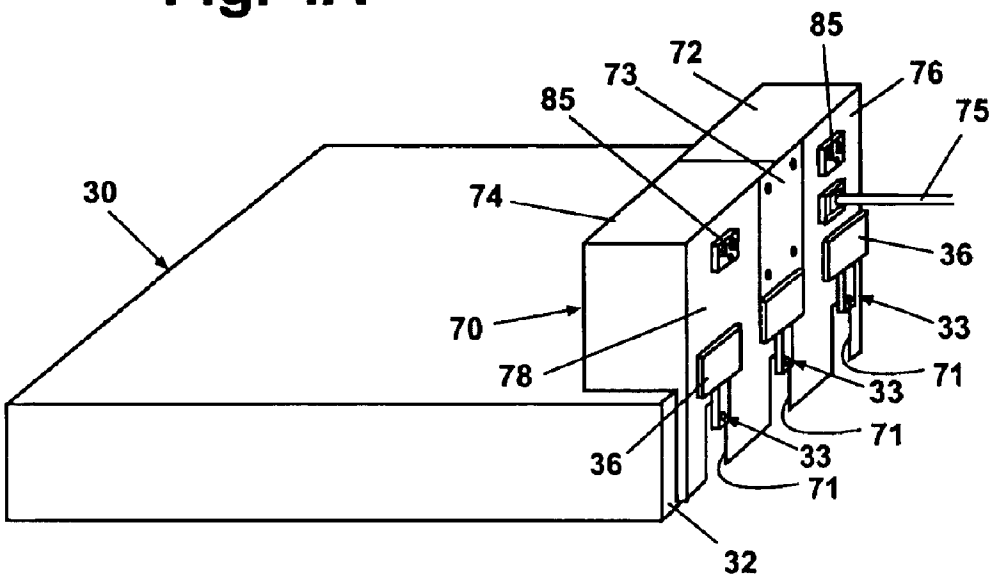
FIG. 4 is a schematic rear perspective view showing a power strip mounted on the modular workbench top.
Figure 4B:
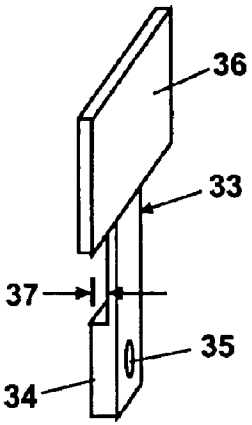
FIG. 4B is a schematic perspective view of a T-bracket for mounting a power strip to a modular workbench top.

Referring to FIG. 4, FIG. 4A and FIG. 4B, a schematic power strip 70 is shown mounted to a workbench top 30. A plurality of T-brackets 33 can be provided to lock power strip 70 in position on workbench 10. Each T-bracket 33 can be attached to the rear edge 32 of top 30 by fasteners such as conventional lag screws, not shown. T-bracket 33 can include a mounting portion 34 having a mounting hole 35 through which a mounting screw can be driven into rear edge 32 of top 30. Above mounting portion 34 there is an enlarged support portion 36 that can overlie rear panels 76 and 78 to hold power strip firmly on workbench top 30. Rear panels 76 and 78 can have slots 71 formed in the lower end of the rear panels to slide down over mounting portions 34 of T-brackets 33. Mounting portion 34 is thicker than support portion 36 by offset 37 which provides sufficient space for rear panels 76 and 78 of power strip sections 72 and 74 to be slid down between the rear edge 32 of workbench top 30 and support portions 36. The slots 71 in rear panels 76 and 78 can be dimensioned to snuggly fit over mounting portions 34 to hold the power strip 70 in place when installed on a workbench top 30. Those skilled in the art will recognize that power strip sections 72 and 74 could be mounted to workbench top 30 in other ways than as disclosed in FIG. 4–FIG. 4B.

Power strip 70 can be provided in two sections 72 and 74 that extend approximately the full width of top 30. While the embodiment of FIG. 4 and FIG. 4A shows has power strip 70 in two sections, those skilled in the art will recognize that the power strip could be provided in a single piece, and that power strip 70 could extend less than the full width of top 30. Power strip sections 72 and 74 can be joined by a connecting plate 73 attached to the rear panels 76 and 78 of power strip sections 72 and 74. A suitable electrical connector can be provided to electrically connect power strip sections 72 and 74 at the respective ends of power strip sections 72 and 74, not shown, and covered by connecting plate 73. A suitable power cord 75 can be provided at the rear panel 76 of section 72 to connect the power strip 70 to a power source, not shown. A suitable strain relief can be provided to mount power cord 75 to rear panel 76 as is well known to those skilled in the art. Power cord 75 can be provided in any desired length to readily connect power strip 70 to a power source. In the embodiment shown in FIG. 4, power cord 75 can be twenty feet long. A plurality of electrical outlets 84 can be provided on the front panels 80 and 82 of power strip sections 72 and 74. Electrical outlets 85 can be provided on rear panels 76 and 78 to provide a power source for a refrigerator module 60, a light fixture for workbench 10, not shown, or other electrically operated device that is not used on the workbench top 30. The electrical outlets 84, 85, can be commercially available panel outlets consisting of a terminal block and a cover that can be snapped into cutouts in the front and rear panels. In addition, a ground fault circuit interrupter (GFCI) outlet 86 can be provided on front panel 80 through which the other outlets 84 and 85 can be connected. GFCI outlet 86 can be provided with an on/off switch 87 and test and reset buttons as is well known in the art. After electrical outlets 84, 85 and GFCI outlet 86 are installed in the front and rear panels, the outlets can be connected by electrical wire to a power cord 75 as is well known to those skilled in the art. While a GFCI outlet is shown in the embodiment of FIG. 4 and FIG. 4A, GFCI outlet 87 could be replaced with an on/off switch, an overload protector or a surge protector or any combination thereof as is well known to those skilled in the art.

The power strip housing including front panels 80 and 82 and rear panels 76 and 78 can be can be formed of metal and painted as other metal parts of the modular workbench 10, although those skilled in the art will understand that a plastic housing could be used. After installation of the electrical outlets and connecting the electrical outlets and power cord, the power strip housing can be assembled using threaded fasteners as is well known to those skilled in the art.

Figure 6:
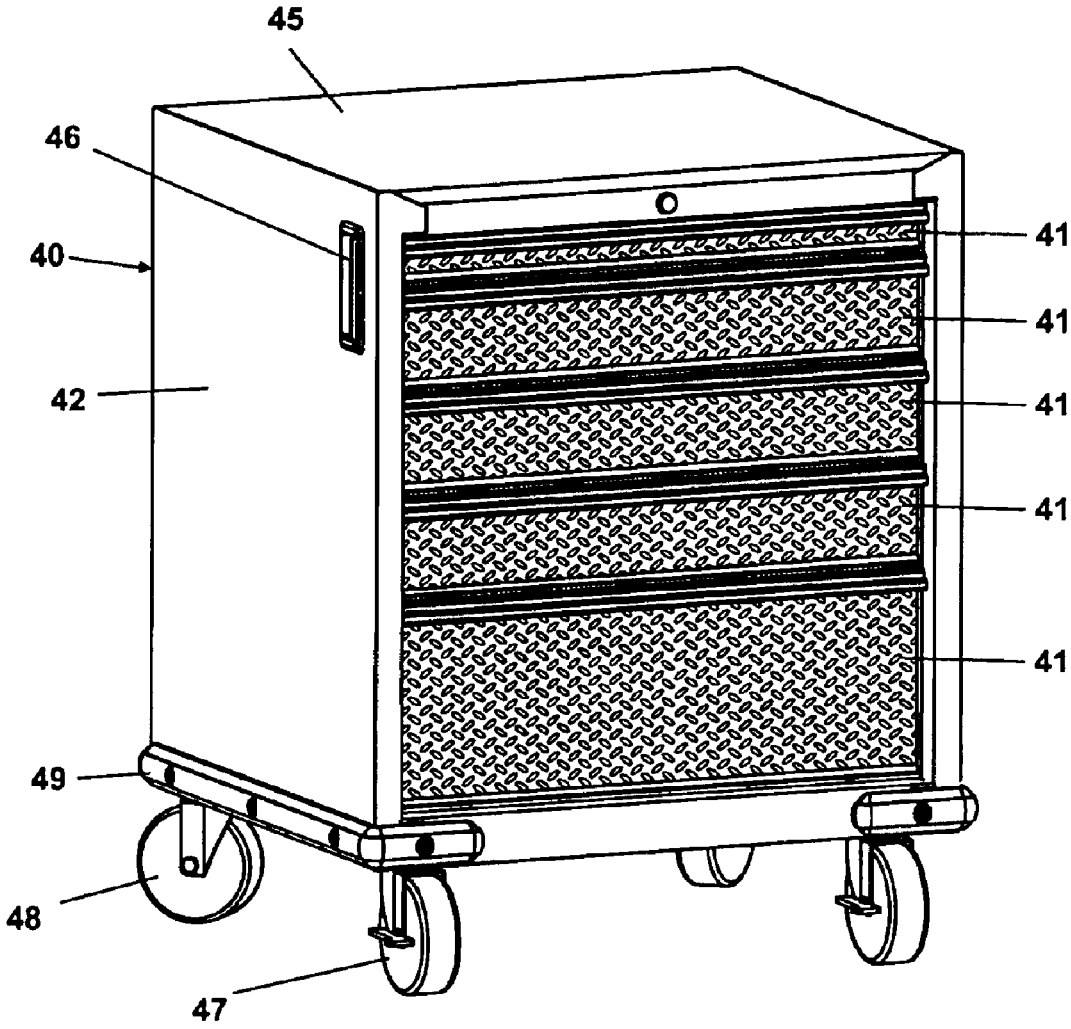
FIG. 6 is a front perspective view of a drawer module.
Figure 7:
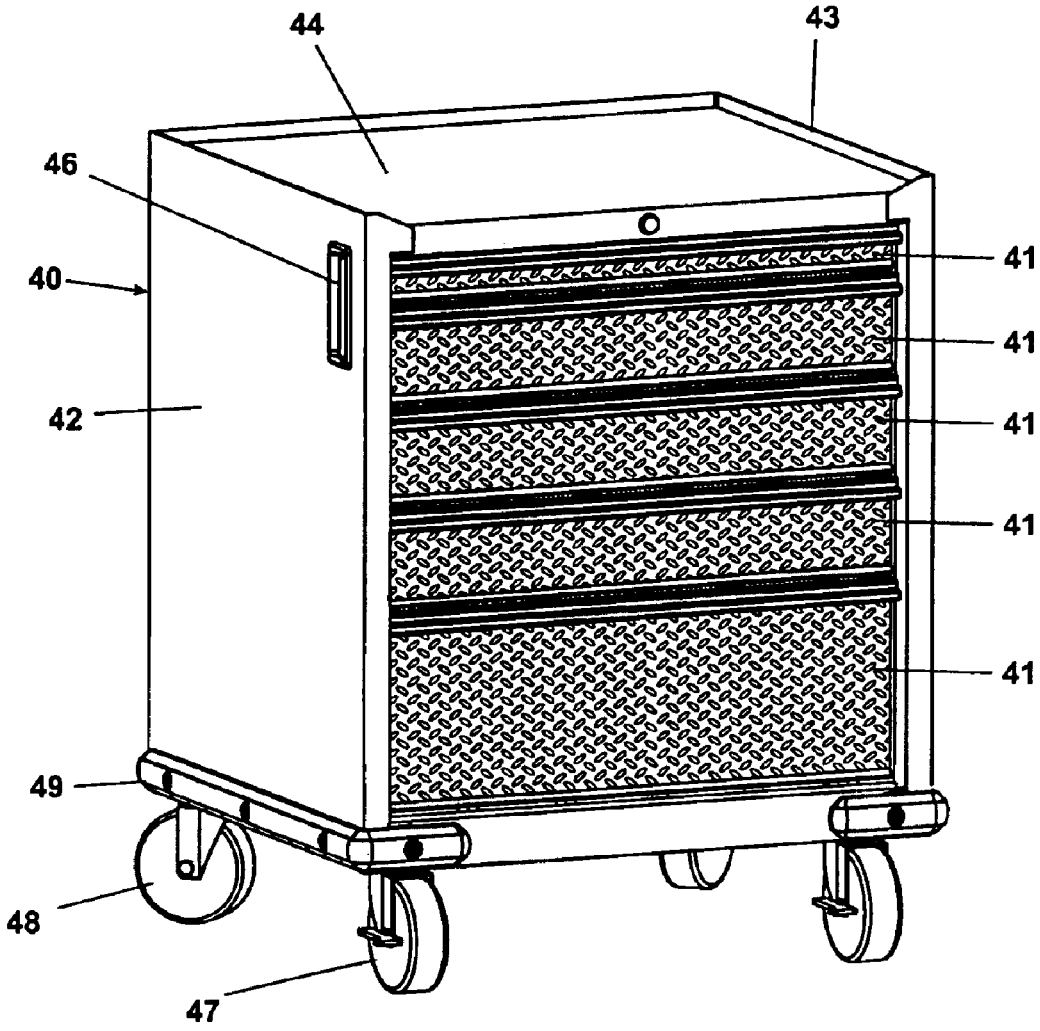
FIG. 7 is a front perspective view of a drawer module without the optional wood worksurface.

Referring to FIG. 6 and FIG. 7, a drawer module 40 is shown. Drawer module 40 can have a plurality of drawers 41 each mounted on tracks for easy access as are well known to those skilled in the art. The face of each drawer 41 can have an ornamental treadplate pattern surface that is the subject of co-pending design patent application US2002314 filed concurrently herewith. Drawer module 40 can have a cabinet 42 having a raised top edge 43 that forms a work surface 44 and also can form a frame for an optional hardwood work surface 45 that can be sized to fit tightly inside raised top edge 43. Drawer module 40 can have a pair of fixed casters 47 mounted at the front of module 40 that are aligned with the sides of cabinet 42 to facilitate rolling drawer module 40 under and out from underneath workbench 10. Drawer module 40 can also have a pair of swivel casters 48 mounted at the rear of drawer module 40 to facilitate movement of drawer module 40 to any desired location. Casters 47 and 48 are large heavy-duty casters to provide a sturdy, stable module that can be used as a portable worksurface. Casters 47 and 48 are also sized so that the height of drawer module 40 with casters installed is approximately the same height as the other modules (even though the cabinet height of other modules may differ) and so that drawer module 40 fits easily under workbench 10. Drawer module 40 can have side handles 46 in the side walls of cabinet 42 to facilitate moving drawer module 40. Side handles 46 allow a user to grasp both sides of cabinet 42 to position drawer module 40 as desired on casters 47 and 48. Drawer module 40 can also have a bumper 49 on the lower sidewalls of cabinet 42 that wraps around the front and rear corners of cabinet 42. Bumper 49 prevents adjoining modules from striking one another when being moved into and out of docking underneath workbench 10, or from striking other objects and damaging or scratching the cabinet walls. Bumper 49 can be fabricated of vinyl, other plastic material, or a mixture of plastic and rubber material, or other suitable bumper material as is well known to those skilled in the art. Bumper 49 can be attached to drawer module 40 using screws or other suitable fasteners. Fixed casters 47 can be locking casters as shown in the embodiment of FIG. 6 and FIG. 7 to facilitate use as a mobile work surface or to maintain drawer module 40 in position under workbench 10.

Figure 8:
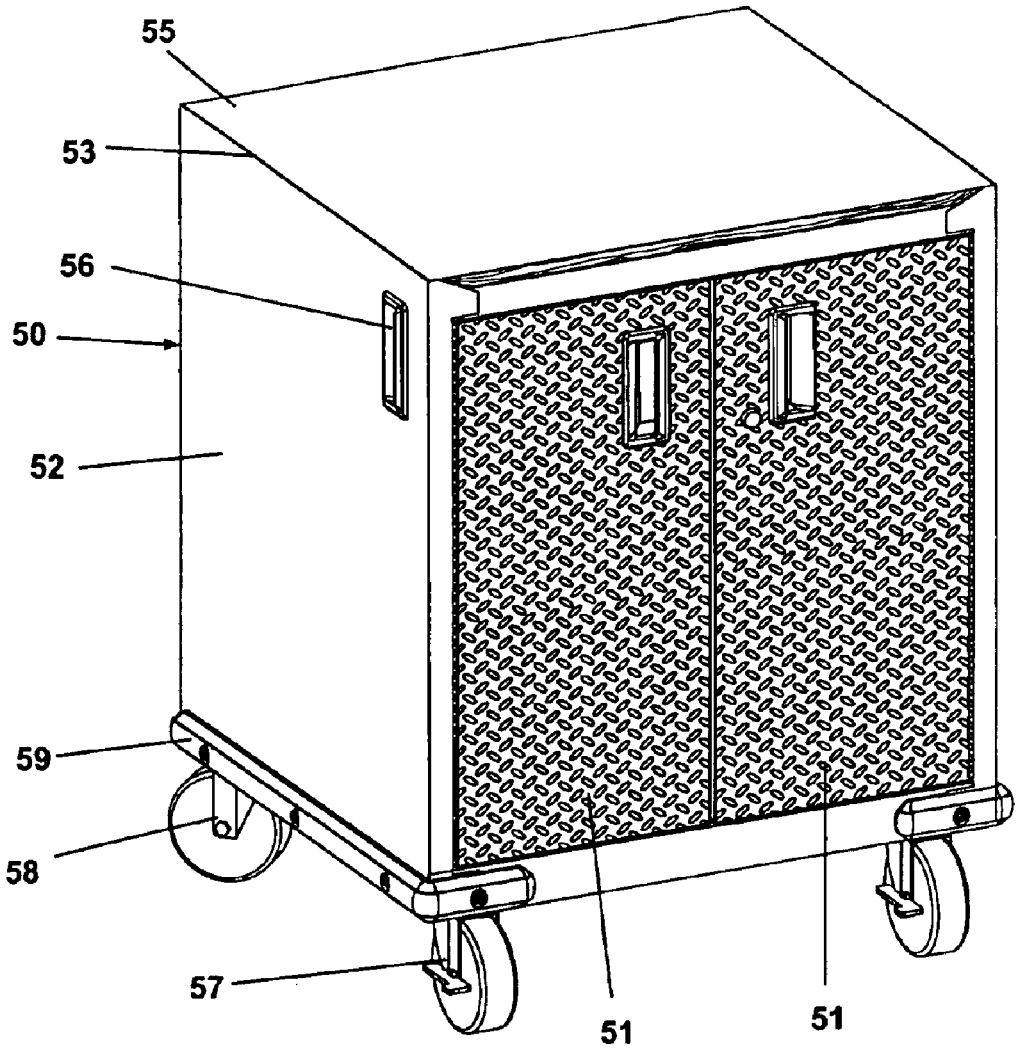
FIG. 8 is a front perspective view of a cabinet module.

Referring to FIG. 8, a storage cabinet module 50 is shown. Storage cabinet module 50 can have a pair of doors 51 hinged to the front edge of cabinet 52. Doors 51 can have an ornamental treadplate pattern surface that is the subject of co-pending design patent application US20020315 filed concurrently with this application. Storage cabinet module 50 can have a cabinet 52 having a raised top edge 53 that forms a work surface, not shown covered by hard wood work surface 55, and also can form a frame for an optional hardwood work surface 55 that can be sized to fit tightly inside raised top edge 53. Storage cabinet module 50 can have a pair of fixed casters 57 mounted at the front of storage cabinet module 50 that are aligned with the sides of cabinet 52 to facilitate rolling storage cabinet module 50 under and out from underneath workbench 10. Storage cabinet module 50 can also have a pair of swivel casters 58 mounted at the rear of storage cabinet module 50 to facilitate movement of storage cabinet module 50 to any desired location. Casters 57 and 58 are large heavy-duty casters to provide a sturdy stable module that can be used as a portable worksurface. Casters 57 and 58 are also sized so that the height of storage cabinet module 50 with casters installed is approximately the same height as the other modules (even though the cabinet height of other modules may differ) and so that module 50 fits easily under workbench 10. Storage cabinet module 50 can have side handles 56 in the side walls of cabinet 52 to facilitate moving storage cabinet module 50. Side handles 56 allow a user to grasp both sides of cabinet 52 to position storage cabinet module 50 as desired on casters 57 and 58. Storage cabinet module 50 can also have a bumper 59 on the lower sidewalls of cabinet 52 that wraps around the front and rear corners of cabinet 52. Bumper 59 prevents adjoining modules from striking one another when being moved into and out of docking underneath workbench 10, or from striking other objects and damaging or scratching the cabinet walls. Bumper 59 can be fabricated of vinyl, other plastic material, or a mixture of plastic and rubber material, or other suitable bumper material as is well known to those skilled in the art. Bumper 59 can be mounted to module 50 using screws or other fasteners as desired. Fixed casters 57 can be locking casters as shown in the embodiment of FIG. 8 to facilitate use as a mobile work surface or to maintain storage cabinet module 50 in position under workbench 10.

Figure 9:
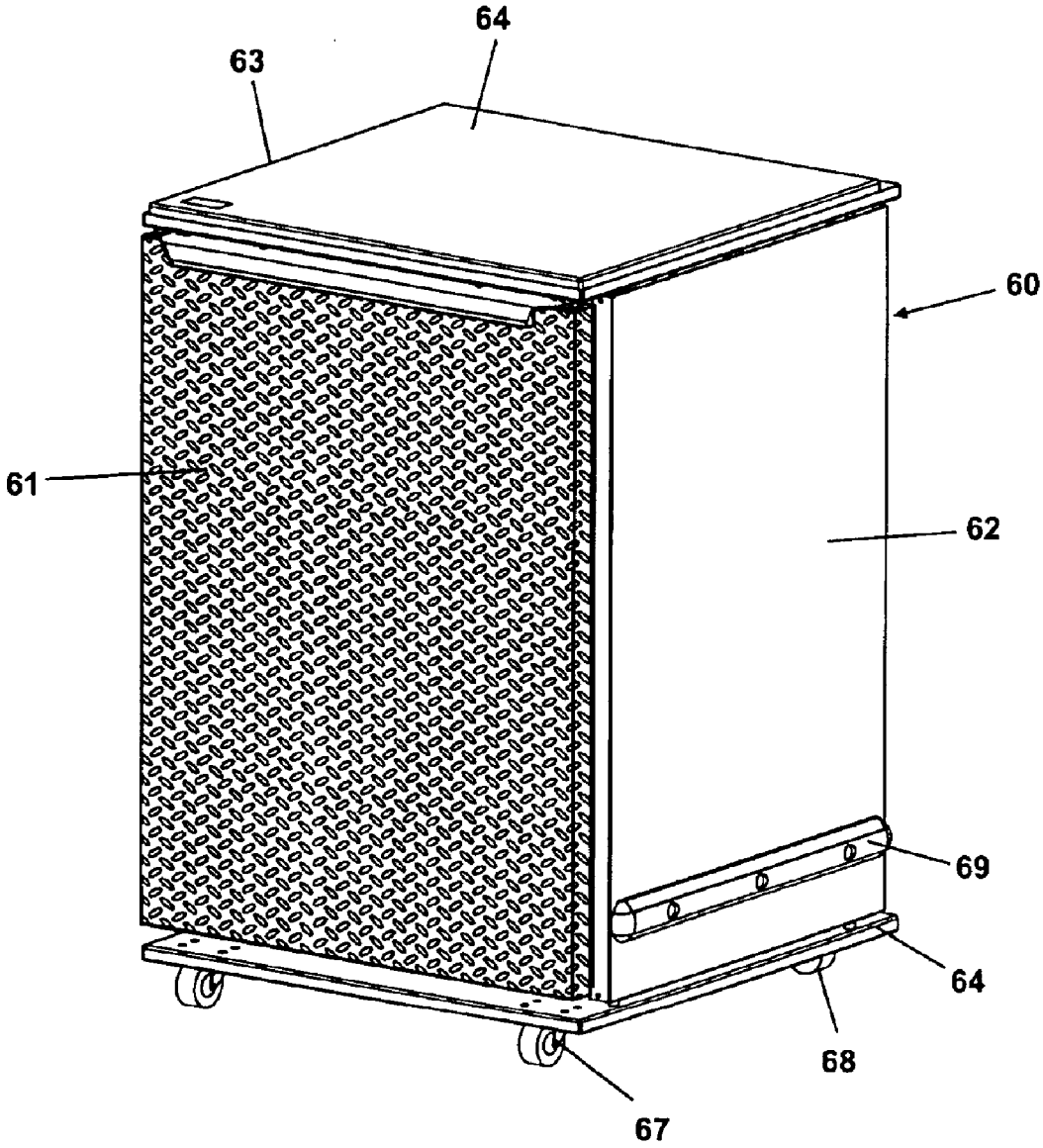
FIG. 9 is a front perspective view of a refrigerator module.

Referring to FIG. 9, a refrigerator module 60 is shown. As mentioned above, refrigerator module 60 can be a low ambient temperature refrigerator as disclosed in co-pending patent application US20020323 filed concurrently herewith and which is incorporated by reference. Refrigerator module 60 can have a cabinet 62 having a hinged door 61 mounted on the front of cabinet 62. Door 61 can have an ornamental treadplate pattern surface that is the subject matter of co-pending design patent application US20020316 filed concurrently herewith. Refrigerator module 60 can have a top tray 63 and a bottom tray 64 that are attached to the top and bottom of cabinet 62. Top tray 63 can form a work surface 64 and also a frame for an option hardwood work surface, not shown, that can be sized to fit tightly inside top tray 63. Top tray 63 can have a vent, not shown, in the rear edge of tray 63 to facilitate cooling of a condenser, not shown, mounted on the rear wall of cabinet 62 as disclosed in the above identified co-pending patent application US20020323 and incorporated by reference. The optional hardwood work surface can be sized to assure that the vent is not covered when a hardwood work surface is installed. Top tray 63 and bottom tray 64 can extend beyond the rear surface of cabinet 62 to protect the static condenser. Refrigerator module 60 can have a pair of fixed casters 67 mounted at the front of refrigerator module 60 that are aligned with the sides of cabinet 62 to facilitate rolling refrigerator module 60 under and out from underneath workbench 10. Refrigerator module 60 can also have a pair of swivel casters 68 mounted at the rear of refrigerator module 60 to facilitate movement of refrigerator module 60 to any desired location. Casters 67 and 68 are heavy-duty casters to provide a sturdy stable module that can be used as a portable worksurface. Casters 67 and 68 are also sized so that the height of refrigerator module 60 with casters installed is approximately the same height as the other modules (even though the cabinet height of other modules may differ) and so that refrigerator module 60 fits easily under workbench 10. Module 60 can also have a bumper 69 on the lower sidewalls of cabinet 62. Bumper 69 prevents adjoining modules from striking one another when being moved into and out of docking underneath workbench 10, or from striking other objects and damaging or scratching the cabinet walls. Bumper 69 can be fabricated of vinyl, other plastic material, or a mixture of plastic and rubber material, or other suitable bumper material as is well known to those skilled in the art. Bumper 69 can be mounted to module 60 using screws or other fasteners as desired. Fixed casters 67 can be locking casters as shown in the embodiment of FIG. 9 to facilitate use as a mobile work surface or to maintain refrigerator module 60 in position under workbench 10.

Each of modules 40, 50 and 60 can be sized and provided with casters such that each of the modules fits easily under workbench 10. In the embodiment shown in FIG. 1, there can be approximately 1 and ½ inches clearance between the top of the modules with an optional hardwood worksurface in place and the underneath side of top 30. While the modules disclosed in the embodiment of FIG. 1, FIG. 6, FIG. 7, FIG. 8 and FIG. 9 are approximately the same height when provided with casters as discussed above, those skilled in the art will recognize that the height of modules, with casters installed, could be substantially identical, or could be designed to differ in height as desired. The clearance space between the tops of modules 40, 50 and 60 coupled with vents 27 in stringer 15 provides adequate ventilation under workbench 10 when a refrigerator module 60 is in use and the condenser (not shown) is releasing heat under workbench 10. Those skilled in the art will recognize that vents 27 and/or the clearance space above modules 40, 50 and 60 can be changed as desired to provide more or less ventilation under workbench 10. Vents 27 can be located on stringer 15 to be centered with respect to each module, in embodiment of FIG. 1 and FIG. 3 three modules. Those skilled in the art will understand that if workbench 10 is modified to provide for docking of two or more that three modules the number of vents 27 in stringer 15 can be modified to correspond to the number of modules that can be docked under workbench 10.

While the invention has been specifically described in connection with certain specific embodiments thereof, it is to be understood that this is by way of illustration and not of limitation, and the scope of the appended claims should be construed as broadly as the prior art will permit.

We claim:

1. A modular workbench system comprising:

a workbench having an elongated workbench top supported on a plurality of spaced apart legs positioned at opposite ends of said workbench top, said workbench defining an open space bounded by the floor, said plurality of spaced apart legs and said workbench top for docking a plurality of mobile modules; and one or more modules having a cabinet including a pair of sidewalls movably mounted on casters and sized for docking underneath said workbench top for storage and access, and for movement from underneath said workbench top for rearrangement of said modules, and for access to said modules away from said workbench for use as a mobile worksurface or for cleaning under said workbench, said one or more movable modules being selected from the group including, but not limited to, a drawer module having a plurality of pullout drawers, a storage cabinet module having a pair of doors to close said storage cabinet, and a refrigerator module for providing refrigerated storage, wherein said casters for respective modules are sized so that each of said modules mounted on their respective casters are approximately the same height.

2. The modular workbench system of claim 1 wherein said workbench defines a space for docking three modules.

3. The modular workbench system of claim 1 wherein said workbench top comprises laminated elongated maple strips.

4. The modular workbench system of claim 1 wherein one or more of said modules has a top surface having a perimetrical flange extending above the top surface of said module and is arranged to receive and retain an optional wood top on said module.

5. The modular workbench system of claim 4 wherein said optional wood top comprises laminated elongated maple strips.

6. The modular workbench system of claim 1 wherein each of said module cabinets has a resilient bumper strip adjacent the bottom edge of said sidewalls a predetermined distance from the floor to prevent each of said modules from scraping an adjacent module upon withdrawal or docking of said modules under said workbench.

7. The modular workbench of claim 6 wherein each of said bumper strips on the sidewalls of said drawer module and said storage cabinet module extend around the intersections of said sidewalls and the front and rear walls of said modules and terminate a predetermined distance from the intersection of the sidewalls with the front and rear walls.

8. A modular workbench system comprising:

a workbench having an elongated workbench top supported on a plurality of spaced apart legs positioned at opposite ends of said workbench top, said workbench defining a space bounded by the floor, said plurality of spaced apart legs and said workbench top for docking a plurality of mobile modules; and one or more modules movably mounted on casters and sized for docking underneath said workbench top for storage and access, and for movement from underneath said workbench top for rearrangement of said modules, and for access to said modules away from said workbench for use as a mobile worksurface or for cleaning under said workbench, said one or more movable modules being selected from the group including, but not limited to, a drawer module having a plurality of pullout drawers, a storage cabinet module having a pair of doors to close said storage cabinet, and a refrigerator module for providing refrigerated storage, wherein said modules have a cabinet and said casters for respective modules are sized so that each of said modules mounted on their respective casters are approximately the same height; wherein the casters for said modules include two fixed casters at the front of said module aligned with the sidewalls of said module and two pivotal casters at the rear of said module, thereby facilitating docking and withdrawal of said modules from underneath said workbench top along a path parallel to said plurality of spaced apart legs positioned at opposite ends of said workbench top.

9. A modular workbench system comprising:

a workbench having an elongated workbench top supported on a plurality of spaced apart legs positioned at opposite ends of said workbench top, said workbench defining a space bounded by the floor, said plurality of spaced apart legs and said workbench top for docking a plurality of mobile modules; and one or more modules movably mounted on casters and sized for docking underneath said workbench top for storage and access, and for movement from underneath said workbench top for rearrangement of said modules, and for access to said modules away from said workbench for use as a mobile worksurface or for cleaning under said workbench, said one or more movable modules being selected from the group including, but not limited to, a drawer module having a plurality of pullout drawers, a storage cabinet module having a pair of doors to close said storage cabinet, and a refrigerator module for providing refrigerated storage, wherein said modules have a cabinet and said casters for respective modules are sized so that each of said modules mounted on their respective casters are approximately the same height; wherein said workbench has a backsplash mounted adjacent to said workbench top having a front vertical surface adjacent said workbench top, said backsplash includes one or more electrical outlets on said front vertical surface, and said electrical outlets are connected to power cord extending from said backsplash to connect said electrical outlets to a power source.

10. The modular workbench system of claim 9 wherein said backsplash has a rear vertical surface opposite said front vertical surface and said backsplash includes one or more electrical outlets on said rear vertical surface.

11. The modular workbench system of claim 9 wherein the first of said electrical outlets connected to said power cord is a ground fault circuit interrupter outlet mounted on said front vertical surface and the remaining electrical outlets are connected to said power cord through said ground fault circuit interrupter outlet.

12. The modular workbench system of claim 9 wherein said electrical outlets are connected to said power cord through an ON/OFF switch mounted on said front vertical surface.

13. The modular workbench system of claim 9 wherein said electrical outlets are connected to said power cord through an overload protector.

14. A modular workbench system comprising:

a workbench having an elongated workbench top supported on a plurality of spaced apart legs positioned at opposite ends of said workbench top, said workbench defining a space bounded by the floor, said plurality of spaced apart legs and said workbench top for docking a plurality of mobile modules; and one or more modules movably mounted on casters and sized for docking underneath said workbench top for storage and access, and for movement from underneath said workbench top for rearrangement of said modules, and for access to said modules away from said workbench for use as a mobile worksurface or for cleaning under said workbench, said one or more movable modules being selected from the group including, but not limited to, a drawer module having a plurality of pullout drawers, a storage cabinet module having a pair of doors to close said storage cabinet, and a refrigerator module for providing refrigerated storage, wherein said modules have a cabinet and said casters for respective modules are sized so that each of said modules mounted on their respective casters are approximately the same height; wherein said workbench system is adapted to be used in a non-climate controlled space and said workbench top comprises laminated elongated hardwood strips, and said spaced apart legs at opposite ends of said workbench top have a plate connecting the tops of said spaced apart legs at each end of said workbench top, and said plate has a plurality of elongated mounting holes for receiving a threaded fastener for connecting said spaced apart plurality of legs at opposite ends of said workbench to said workbench top to allow expansion and contraction of said workbench top due to changes in humidity.

15. The modular workbench system of claim 14 wherein said elongated mounting holes in said plate connecting said spaced apart legs at opposite ends of said workbench top are elongated in a direction perpendicular to the direction of the elongated strips comprising said workbench top.

16. A modular workbench system comprising:

a workbench having an elongated workbench top supported on a plurality of spaced apart legs positioned at opposite ends of said workbench top, said workbench defining a space bounded by the floor, said plurality of spaced apart legs and said workbench top for docking a plurality of mobile modules; and one or more modules movably mounted on casters and sized for docking underneath said workbench top for storage and access, and for movement from underneath said workbench top for rearrangement of said modules, and for access to said modules away from said workbench for use as a mobile worksurface or for cleaning under said workbench, said one or more movable modules being selected from the group including, but not limited to, a drawer module having a plurality of pullout drawers, a storage cabinet module having a pair of doors to close said storage cabinet, and a refrigerator module for providing refrigerated storage, wherein said modules have a cabinet and said casters for respective modules are sized so that each of said modules mounted on their respective casters are approximately the same height; wherein said spaced apart legs at opposite ends of said workbench top are connected by a stringer and said stringer includes a plate positioned against said workbench top and includes a plurality of mounting holes for receiving fasteners for connecting said workbench top to said stringer.

17. The modular workbench system of claim 16 wherein said mounting holes in said stringer are sized to receive said fasteners.

18. The modular workbench system of claim 16 wherein said stringer has a plurality of vents through said stringer for venting the space underneath said workbench to prevent heat build up when a refrigerator module is included in the workbench system.

19. A modular workbench system comprising:

a workbench having an elongated workbench top supported on a plurality of spaced apart legs positioned at opposite ends of said workbench top, said workbench defining a space bounded by the floor, said plurality of spaced apart legs and said workbench top for docking a plurality of mobile modules; and one or more modules movably mounted on casters and sized for docking underneath said workbench top for storage and access, and for movement from underneath said workbench top for rearrangement of said modules, and for access to said modules away from said workbench for use as a mobile worksurface or for cleaning under said workbench, said one or more movable modules being selected from the group including, but not limited to, a drawer module having a plurality of pullout drawers, a storage cabinet module having a pair of doors to close said storage cabinet, and a refrigerator module for providing refrigerated storage, wherein said modules have a cabinet and said casters for respective modules are sized so that each of said modules mounted on their respective casters are approximately the same height; wherein each of said plurality of spaced apart legs has a leveling mechanism at the bottom end of said legs to level said workbench.

20. A modular workbench system comprising:

a workbench having an elongated workbench top supported on a plurality of spaced apart legs positioned at opposite ends of said workbench top, said workbench defining a space bounded by the floor, said plurality of spaced apart legs and said workbench top for docking a plurality of mobile modules; and one or more modules movably mounted on casters and sized for docking underneath said workbench top for storage and access, and for movement from underneath said workbench top for rearrangement of said modules, and for access to said modules away from said workbench for use as a mobile worksurface or for cleaning under said workbench, said one or more movable modules being selected from the group including, but not limited to, a drawer module having a plurality of pullout drawers, a storage cabinet module having a pair of doors to close said storage cabinet, and a refrigerator module for providing refrigerated storage, wherein said modules have a cabinet and said casters for respective modules are sized so that each of said modules mounted on their respective casters are approximately the same height; wherein said workbench system is adapted for use in an unheated space and said refrigerator module is provided with means for heating the inside of the refrigerator and control means to activate said beating means when the temperature in said unheated space is close to or less than freezing to prevent items stored in said refrigerator module from freezing.

21. A modular workbench system comprising:

a workbench having first and second leg assemblies each comprising a pair of spaced apart legs connected together; a stringer for connecting said first and second leg assemblies and fasteners connecting said stringer to said first and second leg assemblies for forming a leg and stringer assembly; a workbench top supported on said leg and stringer assembly and fasteners connecting said leg and stringer assembly to said workbench top, said workbench defining a space bounded by the floor, said first and second leg assemblies, said stringer and said workbench top for docking a plurality of mobile modules; and one or more modules movably mounted on casters and sized for docking underneath said workbench top for storage and access, and for movement from underneath said workbench top for rearrangement of said modules, and for access to said modules away from said workbench for use as a mobile worksurface or for cleaning under said workbench, said one or more modules being selected from the group including, but not limited to, a drawer module having a plurality of pullout drawers, a storage cabinet module having a pair of doors to close said storage cabinet, and a refrigerator module for providing refrigerated storage, wherein said modules have a cabinet and said casters for respective modules are sized so that each of said modules mounted on their respective casters are generally the same height, and wherein said casters include two fixed casters at the front of said modules aligned with the sidewalls of said modules and two pivotal casters at the rear of said modules thereby facilitating docking and withdrawal of said modules from underneath said workbench top along a path parallel to said first and second leg assemblies.

22. The modular workbench system of claim 21 wherein said workbench system is adapted for use in a non-climate controlled space and said workbench top comprises laminated elongated hardwood strips, and said first and second leg assemblies have a plate connecting the tops of spaced apart legs and said plate has a plurality of elongated mounting holes for receiving a threaded fastener for connecting said first and second leg assemblies to said workbench top and to allow expansion and contraction of said workbench top due to changes in humidity.

23. The modular workbench system of claim 22 wherein said elongated mounting holes in the plate connecting said spaced apart legs in said first and second leg assemblies are elongated in a direction perpendicular to the direction of the elongated strips comprising said workbench top.

24. The modular workbench system of claim 21 wherein said stringer includes a plate positioned against said workbench top and includes a plurality of mounting holes for receiving fasteners for connecting said workbench top to said stringer.

25. The modular workbench system of claim 21 wherein said workbench top comprises laminated elongated maple strips.

26. The modular workbench system of claim 21 wherein said workbench has a backsplash mounted to said workbench top having a front vertical surface adjacent said workbench top, said backsplash includes one or more electrical outlets on said front vertical surface, and said electrical outlets are connected to power cord extending from said backsplash to connect said electrical outlets to a power source.

27. The modular workbench system of claim 26 wherein the first of said electrical outlets connected to said power cord is a ground fault circuit interrupter outlet mounted on said front vertical surface and the remaining electrical outlets are connected to said power cord through said ground fault circuit interrupter outlet.

28. The modular workbench system of claim 26 wherein said electrical outlets are connected to said power cord through an ON/OFF switch mounted on said front vertical surface.

29. The modular workbench system of claim 26 wherein said electrical outlets are connected to said power cord through an overload protector.

30. The modular workbench system of claim 26 wherein said electrical outlets are connected to said power cord through a surge protector.

31. The modular workbench system of claim 26 wherein said backsplash has a rear vertical surface opposite said front vertical surface and said backsplash includes one or more electrical outlets on said rear vertical surface.

32. The modular workbench system of claim 21 wherein each of said spaced apart legs in said first and second leg assemblies has a leveling mechanism at the bottom end of said legs to level said workbench.

33. The modular workbench system of claim 21 wherein each of said modules has a pair of sidewalls each having a bumper strip adjacent the bottom edge of said sidewalls to prevent each of said modules from scraping an adjacent module upon withdrawal or docking of said modules under said workbench.

34. The modular workbench of claim 33 wherein each of said bumper strips on the sidewalls of said drawer module and said storage cabinet module extend around the intersections of said sidewalls and the front and rear walls of said modules and terminate a predetermined distance from the intersection of the sidewalls with the front and rear walls.

35. A modular workbench system adapted for use in a non-climate controlled space comprising:

a workbench having first and second leg assemblies each comprising a pair of spaced apart legs connected together and having a plate connecting the tops of spaced apart legs, said plate having a plurality of elongated mounting holes for slideably receiving a threaded fastener; a stringer for connecting said first and second leg assemblies and having a vertical plate and a mounting flange having a plurality of mounting holes for receiving a fastener; fasteners connecting said vertical plate of said stringer to said first and second leg assemblies for forming a leg and stringer assembly; a workbench top comprising laminated elongated maple strips supported on said leg and stringer assembly; fasteners connecting said plate of said first and second leg assemblies and said stringer mounting flange to said workbench top whereby said elongated holes in said first and second leg assembly plates allow expansion and contraction of said workbench top due to changes in humidity; a backsplash mounted to said workbench top having a front vertical surface adjacent said workbench top, and said backsplash includes one or more electrical outlets on said front vertical surface connected to a power cord extending from said backsplash to connect said electrical outlets to a power source; said workbench defining a space bounded by the floor, said first and second leg assemblies, said stringer and said workbench top for docking a plurality of mobile modules; and one or more modules movably mounted on casters and sized for docking underneath said workbench top for storage and access, and for movement from underneath said workbench top for rearrangement of said modules, and for access to said modules away from said workbench for use as a mobile worksurface or for cleaning under said workbench, said one or more modules being selected from the group including, but not limited to, a drawer module having a plurality of pullout drawers, a storage cabinet module having a pair of doors to close said storage cabinet, and a refrigerator module for providing refrigerated storage, wherein said modules have a cabinet and said casters for respective modules are sized so that each of said modules mounted on their respective casters are substantially the same height, wherein said casters include two fixed casters at the front of said modules aligned with the sidewalls of said modules and two pivotal casters at the rear of said modules thereby facilitating docking and withdrawal of said modules from underneath said workbench top along a path parallel to said first and second leg assemblies, and wherein said one or more of said modules has a top surface having a perimetrical flange extending above the top surface of said module and is arranged to receive and retain an optional wood top comprising laminated elongated maple strips.

36. The modular workbench system of claim 35 wherein said workbench defines a space for docking three modules.

37. The modular workbench system of claim 35 wherein one or more of said modules has a cabinet height different that the height of the cabinet of one or more of the other modules.

38. A modular workbench system adapted for use in an unheated, non-climate controlled space comprising:

a workbench having first and second leg assemblies each comprising a pair of spaced apart legs connected together and having a plate connecting the tops of spaced apart legs said plate having a plurality of elongated mounting holes for slideably receiving a threaded fastener; a stringer for connecting said first and second leg assemblies and having a vertical plate and a mounting flange having a plurality of mounting holes for receiving a fastener; fasteners connecting said stringer vertical plate to said first and second leg assemblies for forming a leg and stringer assembly; a workbench top comprising laminated elongated maple strips supported on said leg and stringer assembly; fasteners connecting said leg and stringer assembly to said workbench top whereby said elongated holes in said first and second leg assembly plates allow expansion and contraction of said workbench top in a direction perpendicular to said elongated dimension of said laminated maple strips due to changes in humidity; a backsplash mounted to said workbench top having a front vertical surface adjacent said workbench top, said backsplash includes one or more electrical outlets on said front vertical surface connected to a power cord extending from said backsplash to connect said electrical outlets to a power source; said workbench defining a space bounded by the floor, said first and second leg assemblies, said stringer and said workbench top for docking three mobile modules; and one, two or three modules movably mounted on casters and sized for docking underneath said workbench top for storage and access, and for movement from underneath said workbench top for rearrangement of said modules, and for access to said modules away from said workbench for use as a mobile worksurface or for cleaning under said workbench, said one, two or three modules being selected from the group including, but not limited to, a drawer module having a plurality of pullout drawers, a storage cabinet module having a pair of doors to close said storage cabinet, and a refrigerator module for providing refrigerated storage and having heating means for heating the inside of said refrigerator module and control means to activate said heating means when the temperature in said unheated space is close to or less than freezing to prevent items stored in said refrigerator module from freezing, wherein said modules have a cabinet and one or more of said modules has a cabinet having a height different than the other modules and said casters for respective modules are sized so that each of said modules mounted on their respective casters are substantially the same height, and wherein said casters include two fixed casters at the front of said modules aligned with the sidewalls of said modules and two pivotal casters at the rear of said modules thereby facilitating docking and withdrawal of said modules from underneath said workbench top along a path parallel to said first and second leg assemblies.

39. The modular workbench system of claim 38 wherein said stringer has a plurality of vents through said stringer for venting the space underneath said workbench to prevent heat build up when a refrigerator module is provided in the workbench system.

40. The modular workbench system of claim 38 wherein each of said spaced apart legs in said first and second leg assemblies have a leveling mechanism at the bottom end of said legs to level said workbench.

41. The modular workbench system of claim 38 wherein said backsplash has a rear vertical surface opposite said front vertical surface and said backsplash includes one or more electrical outlets on said rear vertical surface.

42. The modular workbench system of claim 38 wherein each of said modules has a pair of sidewalls each having a bumper strip adjacent the bottom edge of said sidewalls to prevent each of said modules from scraping an adjacent module upon withdrawal or docking of said modules under said workbench.

43. The modular workbench of claim 42 wherein each of said bumper strips on the sidewalls of said drawer module and said storage cabinet module extend around the intersections of said sidewalls and the front and rear walls of said modules and terminate a predetermined distance from the intersection of the sidewalls with the front and rear walls.

* * * * *

UNITED STATES PATENT AND TRADEMARK OFFICE
Certificate

Patent No. 6,926,376 B2 Patented: August 9, 2005

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Thomas Wesley Arent, St. Joseph, MI (US); Todd Christopher Starr, St. Joseph, MI (US); Allan Ray Steinkuhl, Evansville, IN (US); Mark Allen Stout, Evansville, IN (US); John Richard Wisnoski, Haubstadt, IN (US); Kenneth L. Patricio, Evansville, IN (US); Brent A. Junge, Evansville, IN (US); Travis Michael Perkins, Grange, IN (US); Roger U. Merkel, Evansville, IN (US); Beth M. Lee, Evansville, IN (US); and Wyatt A. Cline, Niles, MI (US).

Signed and Sealed this Twenty-fourth Day of July 2007.

DAVID DUNN
*Supervisory Patent Examiner*
Art Unit 3636